US009016909B2

(12) United States Patent
Sigel

(10) Patent No.: US 9,016,909 B2
(45) Date of Patent: Apr. 28, 2015

(54) CRYSTAL MOUNTING FRAME AND LIGHT ASSEMBLY

(75) Inventor: Brian E. Sigel, Plattsburgh, NY (US)

(73) Assignee: Swarovski Lighting, Ltd., Plattsburg, NY (US)

( * ) Notice: Subject to any disclaimer, the term of this patent is extended or adjusted under 35 U.S.C. 154(b) by 286 days.

(21) Appl. No.: 13/084,296

(22) Filed: Apr. 11, 2011

(65) Prior Publication Data

US 2012/0257391 A1 Oct. 11, 2012

(51) Int. Cl.

| | |
|---|---|
| ***F21V 17/10*** | (2006.01) |
| ***F21S 8/04*** | (2006.01) |
| ***F21V 5/06*** | (2006.01) |
| ***F21V 17/16*** | (2006.01) |
| *F21S 8/06* | (2006.01) |

(52) U.S. Cl.

CPC ..... *F21V 5/06* (2013.01); *Y10T 428/216* (2015.01); *Y10T 29/49908* (2015.01); *Y10T 428/24017* (2015.01); *F21S 8/061* (2013.01); *F21V 17/164* (2013.01); *Y10S 362/806* (2013.01)

USPC ..... 362/433; 362/404; 362/406; 362/457; 362/806

(58) Field of Classification Search

CPC ... F21V 5/06; F21V 17/164; Y10T 29/49908; Y10T 428/216; F21S 8/061

USPC ..... 362/404, 405, 406, 433, 806, 457, 408

See application file for complete search history.

(56) References Cited

U.S. PATENT DOCUMENTS

| | | | | |
|---|---|---|---|---|
| 5,906,430 | A | 5/1999 | Bayer | |
| 5,921,668 | A | 7/1999 | Bayer | |
| 7,261,444 | B2 * | 8/2007 | Bayer et al. | 362/405 |
| 7,318,280 | B2 * | 1/2008 | Bayer et al. | 29/896.4 |
| 7,854,532 | B2 | 12/2010 | Myers, Jr. et al. | |
| 2005/0152149 | A1 | 7/2005 | Bayer | |
| 2008/0175010 | A1 | 7/2008 | Myers et al. | |
| 2010/0140429 | A1 | 6/2010 | Bayer et al. | |

FOREIGN PATENT DOCUMENTS

DE 102009012371 9/2010

OTHER PUBLICATIONS

Smithfield Stainless-Steel Suspension Light, designed by Jasper Morrison, Elle Decoration magazine, p. 137, Jan. 2010.

(Continued)

*Primary Examiner* — Thomas Sember

(74) *Attorney, Agent, or Firm* — Heslin Rothenberg Farley & Mesiti P.C.

(57) ABSTRACT

An ornamental fixture includes a monolithic frame member having a plurality of integral bendable members, and a plurality of ornaments supported on the integral bendable members. The plurality of generally bendable members has a first portion and a second portion. At least a portion of the first portion is bent so that the second portion forms a post receivable in a first opening of a passageway within the ornament, and forms a distal portion extending from a second opening out of the passageway of the ornament. The distal portion is bent to inhibit movement of the ornaments off of the post.

68 Claims, 7 Drawing Sheets

(56) References Cited

OTHER PUBLICATIONS

European Search Report and European Search Opinion dated Oct. 11, 2013, from the European Patent Office, for European Application No. 11005852.6 (which application published as EP 2511604, a copy of the published application being attached to the Search Report and Search Opinion for reference), 20 pages.

European Office Action, EP Patent Application No. 11005852.6 (which application published as EP2511604), 6 pages, Jul. 16, 2014.

* cited by examiner

CRYSTAL MOUNTING FRAME AND LIGHT ASSEMBLY

FIELD OF THE INVENTION

This present invention relates generally to ornamental fixtures and methods for mounting ornaments in ornamental fixtures.

BACKGROUND OF THE INVENTION

Conventionally, crystal ornaments are often suspended from a framework such as in a crystal chandelier. The crystal ornaments are typically attached to a metal wire or hook, which at one end has a loop that passes loosely through a hole in the crystal ornament and at the other end has a loop that passes loosely through a hole in the chandelier framework. In this manner, the crystal ornament hangs from the chandelier framework, in a single orientation.

It is also known to create strings of crystal ornaments, whereby a plurality of crystal ornaments are loosely held together end-to-end by a series of short hooks. Such strings of crystal ornaments also are suspended from a chandelier framework in a single orientation.

U.S. Pat. No. 5,906,430 issued to Bayer discloses a crystal jewel assembly for chandeliers. The assembly provides for securing ornaments onto chandelier frame members without the use of hooks. The lighting fixture is sculpted by attaching ornaments to the frame in a fixed geometric pattern utilizing seating posts and retaining stops on the frame member. The frame member has an aligned position in which the retaining stops hold the crystals in place on the seating posts and a non-aligned position in which the retaining stops are moved whereby the ornaments can be placed on or off the seating posts without obstruction by the retaining stops.

There is a need for further ornamental fixtures and methods for mounting ornaments in ornamental fixtures.

SUMMARY OF THE INVENTION

In a first aspect, the present invention provides an ornamental fixture which includes a monolithic frame member having a plurality of integral bendable members, and a plurality of ornaments supported on the integral bendable members. The plurality of generally bendable members has a first portion and a second portion. At least a portion of the first portion is bent so that the second portion forms a post receivable in a first opening of a passageway within the ornament, and forms a distal portion extending from a second opening out of the passageway of the ornament. The distal portion is bent to inhibit movement of the ornaments off of the post.

In a second aspect, the present invention provides a lighting fixture which includes an ornamental fixture and at least one light source for directing light onto at least some of the ornaments. The ornamental fixture includes a monolithic frame member having a plurality of integral bendable members, and a plurality of ornaments supported on the integral bendable members. The plurality of generally bendable members has a first portion and a second portion. At least a portion of the first portion is bent so that the second portion forms a post receivable in a first opening of a passageway within the ornament, and forms a distal portion extending from a second opening out of the passageway of the ornament. The distal portion is bent to inhibit movement of the ornaments off of the post.

In a third aspect, the present invention provides a frame member for supporting a plurality of ornaments. The frame member includes a monolithic member comprising a plurality of integral bendable members. The plurality of generally bendable members has a first portion and a second portion. At least a portion of the first portion is bent so that the second portion forms a post receivable in a first opening of a passageway within the ornament, and forms a distal portion extending from a second opening out of the passageway of the ornament. The distal portion is bent to inhibit movement of the ornaments off of the post.

In a fourth aspect, the present invention provides a method for attaching a plurality of ornaments to a monolithic frame member having a plurality of integral bendable members. The method includes bending at least a portion of a first portion of the integral bendable member extending from the frame to form a second portions defining a post and a distal portion, inserting the post in a first opening of a passageway in the ornament, and bending the distal portion extending out from a second opening of the passageway of the ornament to inhibit movement of the ornaments off of said post.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
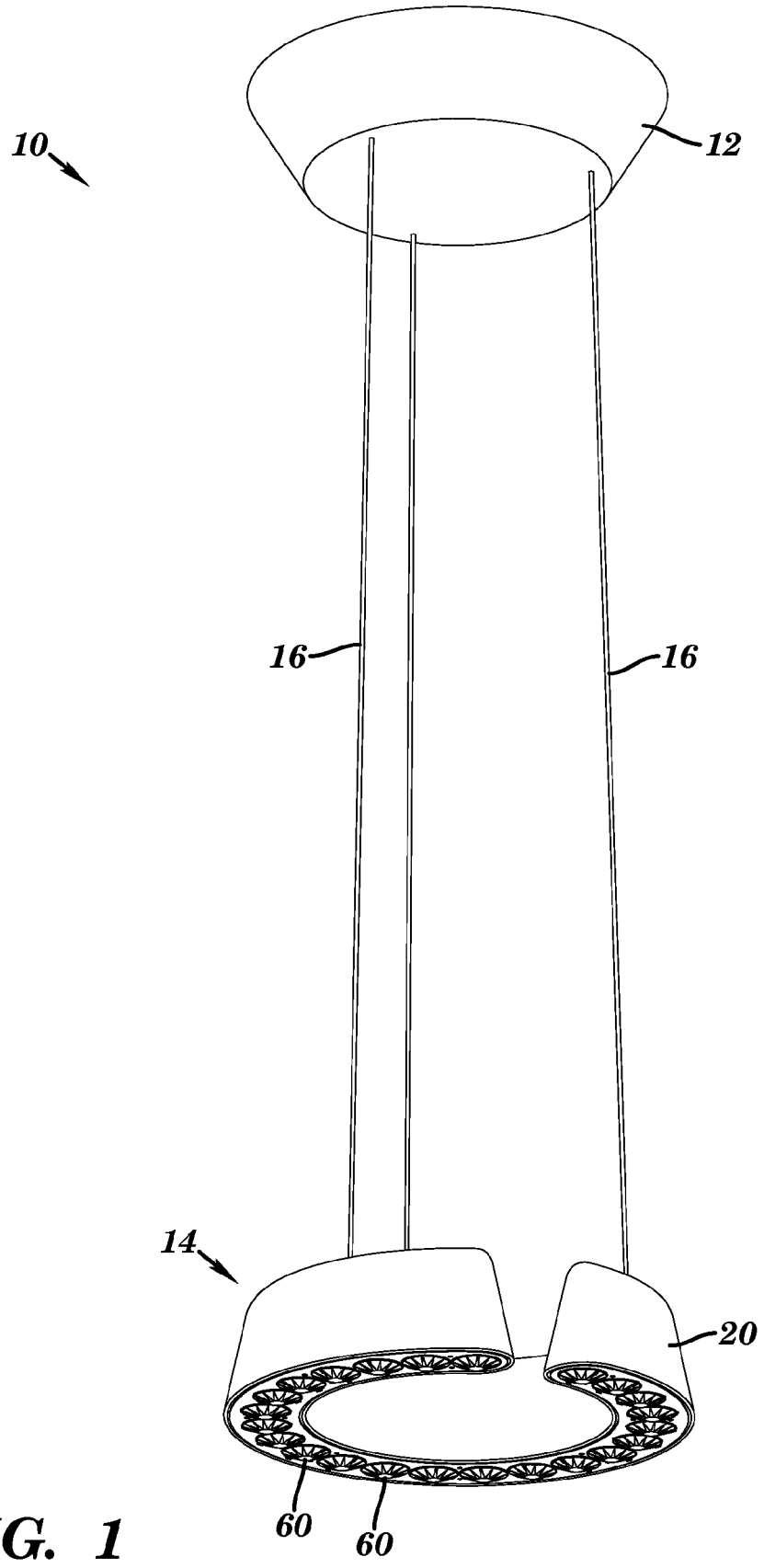
FIG. 1 is a perspective view of one embodiment of a lighting pendent in accordance with one aspect of the present invention.

FIG. 1 illustrates one embodiment of a lighting pendent 10 in accordance with an aspect the present invention. Lighting pendent 10 generally comprises a ceiling mount 12, a light fixture 14, and a plurality of wires 16 for supporting the light fixture from the ceiling mount. The lighting pendent is operably connected to an electrical supply.

Figure 2:
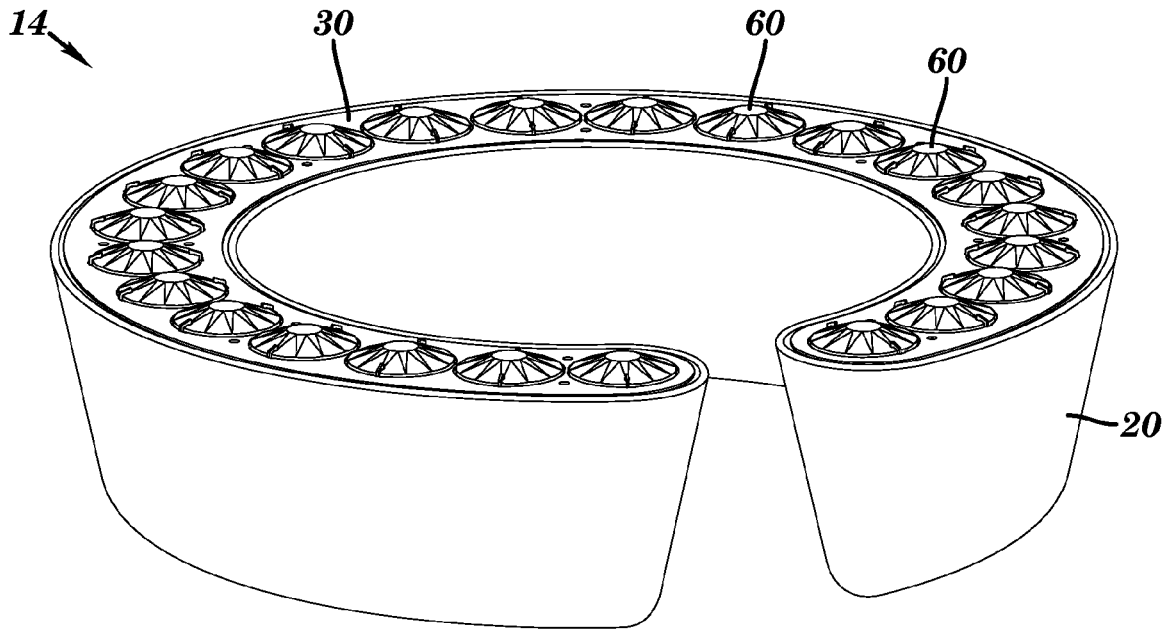
FIG. 2 is an enlarged bottom view of the lighting fixture of the lighting pendent of FIG. 1.

With reference to FIGS. 1 and 2, lighting fixture 14 generally includes a housing 20 in which are disposed one or more light sources (not shown in FIGS. 1 and 2), a frame member 30 (best shown in FIG. 2), which supports a plurality of ornaments 60 such as glass crystals, along the bottom surface of the lighting fixture. As described below, generally the frame member may be a monolithic planar frame member having a plurality of integral bendable and deformable members which bendable and deformable members are bent or deformed to secure the ornaments to the frame.

Figure 3:
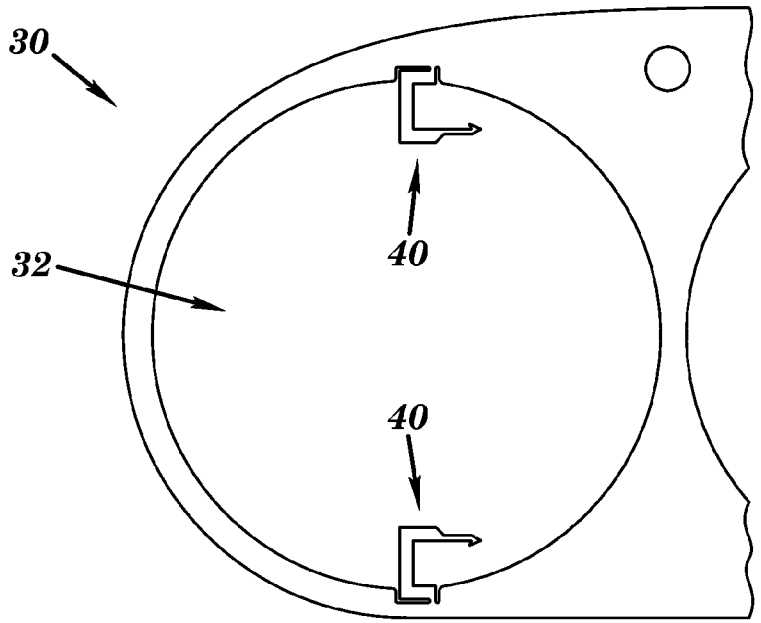
FIG. 3 is an enlarged plan view of a portion of the frame of FIG. 2 for holding an ornament in accordance with an aspect of the present invention.

For example, as shown in FIG. 3, a portion of frame member 30 defines a plurality of cutouts 32 such as circular cutouts (one complete cutout being shown in FIG. 3), and one or more integral bendable members 40 extending into the cutout. The configuration of the frame member is after being formed and prior to attaching the bendable members to an ornament.

Frame member 30 may be formed from a single piece of material whereby the bendable members are preferably bendable and/or twistable. Frame member 30 may be formed by any suitable method using materials such as metal or plastic. For example, the frame member may be cut by a laser from flat sheet metal such as sheet metal steel having a thickness of about 0.040 inches (about 1 millimeter). In selecting the material of the frame member and its dimensions, the bendable members of the frame member is desirably bendable and/or twistable to permit secure attachment of the ornaments as described in greater detail below.

Figure 4:
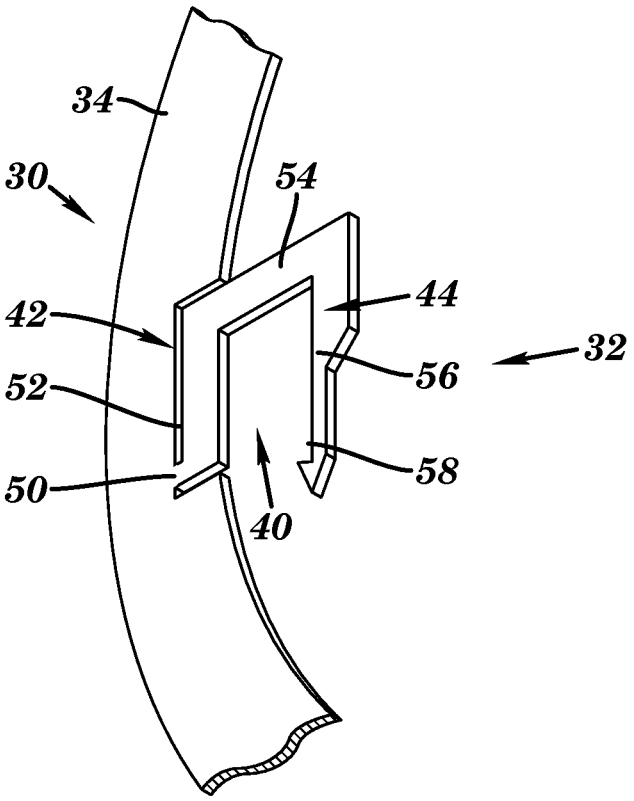
FIG. 4 is an enlarged perspective view of a portion of the frame of FIG. 3, as initially formed having a planar configuration, and illustrating in greater detail, the integral bendable member prior to attaching an ornament.

FIG. 4 illustrates an enlarged portion of frame member 30 having an outer portion 34 defining cutout 32 and inwardly extending bendable member 40 as desirably formed and prior to using the bendable member to attach an ornament to the frame.

Bendable member 40 may include a first portion 42 and a second portion 44. In this illustrated embodiment, first portion 42 and second portion 44 may define a first leg 52, a second leg 54, and a third leg 56. As described below leg 56 defines a post receivable in a passageway in the ornament (not shown), and distal portion 58 for maintaining the ornament on the post. While the bendable member is illustrated as being generally U-shaped, from the present description it will be appreciated that other configurations may be suitably employed.

Figure 5:
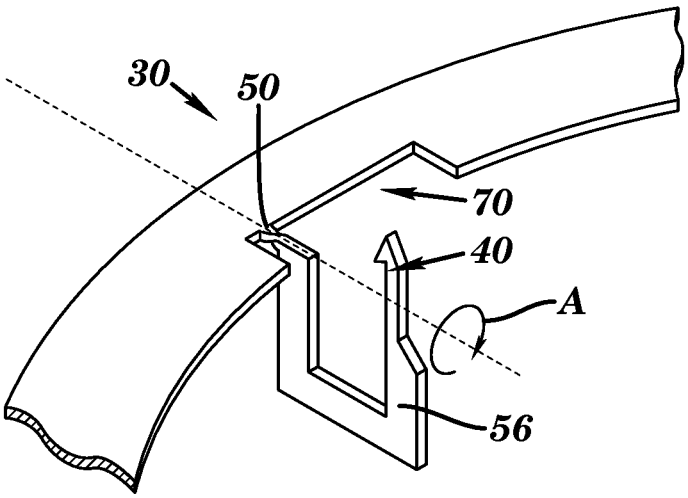
FIG. 5 is an enlarged perspective view of a portion of the frame of FIG. 2 illustrating in greater detail the integral bendable member being bent and configured for receiving an ornament.

With reference to FIG. 5, initially bendable member 40 is rotated from being disposed in the plane of frame member 30 to being displaced from the plane of frame member 30, for examples, directed out of the plane of frame member 30, such as disposed normal or 90-degrees from the plane of the frame member. For example, at least a portion 50 of first portion 42 is bent or twisted so that third leg 56 of second portion 44 forms a post.

Figure 6:
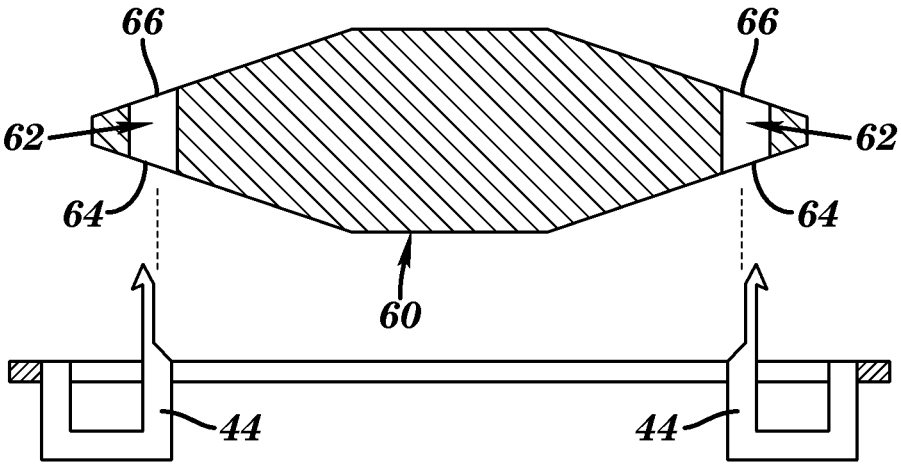
FIG. 6 is a side elevational view, in part cross-section, of a portion of the frame of FIG. 2 illustrating in greater detail the integral bendable members configured for receiving an ornament.
Figure 7:
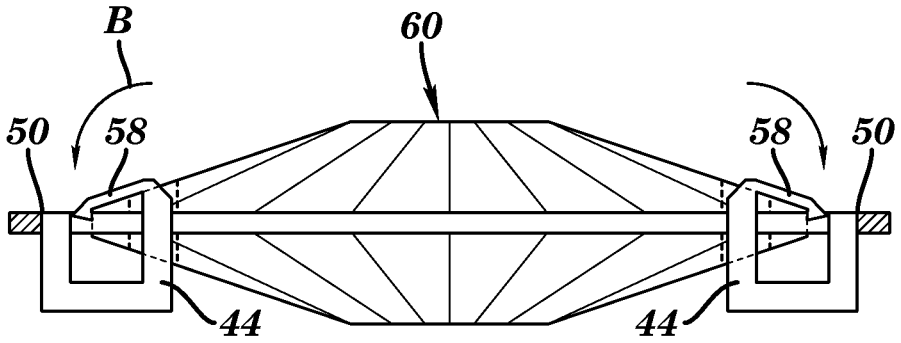
FIG. 7 is a side elevational view, in part cross-section, of the portion of the frame of FIG. 2 illustrating the ornament received and locked on the integral bendable members.

FIG. 6 illustrates an ornament 60, such as a glass crystal. In this illustrated embodiment, ornament 60 includes two passageways 62 extending through the ornament adjacent to a peripheral edge of the ornament. As best shown in FIG. 7, each of second portions 44 are received in a first opening 64 (FIG. 6) of passageway 62 within the ornament with the distal portion 58 extending from a second opening 66 (best shown in FIG. 6) out of passageway 62 (FIG. 6) of ornament 60. Distal portion 58 is bent to inhibit movement of ornaments 60 off of the post.

With reference again to FIG. 5, in this illustrated frame member 30, at least a portion of first portion 42 is disposed in a recess 70. This configuration allows the ornament to be disposed generally adjacent the entire inner edge of cutout 32.

With reference to FIGS. 5 and 7, it is noted that portion 50 of first portion 42 is bent or twisted in a first direction as indicated by arrow A (FIG. 5), and distal portion of second portion is bent in a second direction, as indicated by arrow B (FIG. 7), different from the first direction.

Figure 8:
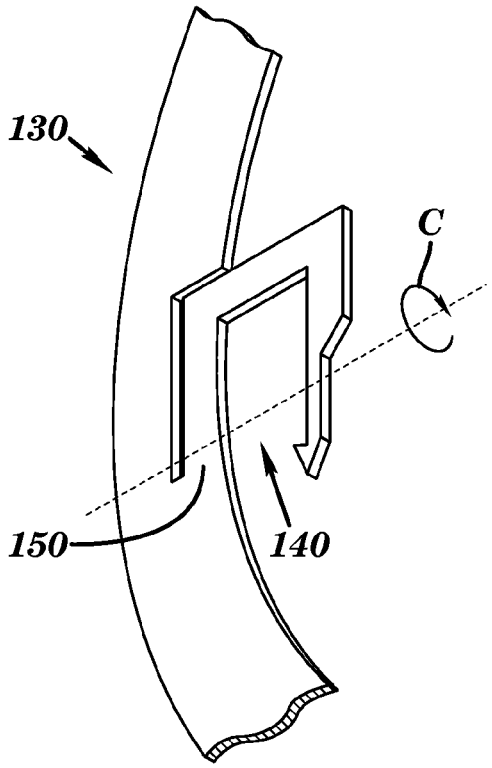
FIG. 8 is a perspective view of a portion of another embodiment of a frame, as initially formed having a planar configuration, illustrating in greater detail the integral bendable member prior to attaching an ornament.

FIG. 8 illustrates another embodiment of a frame 130, as initially formed having a planar configuration, illustrating the integral bendable member 140 prior to attaching an ornament in accordance with an aspect of the present invention. In this embodiment, initially, bendable member 140 may be bent downwardly along portion 150, as indicated by arrow C.

Figure 9:
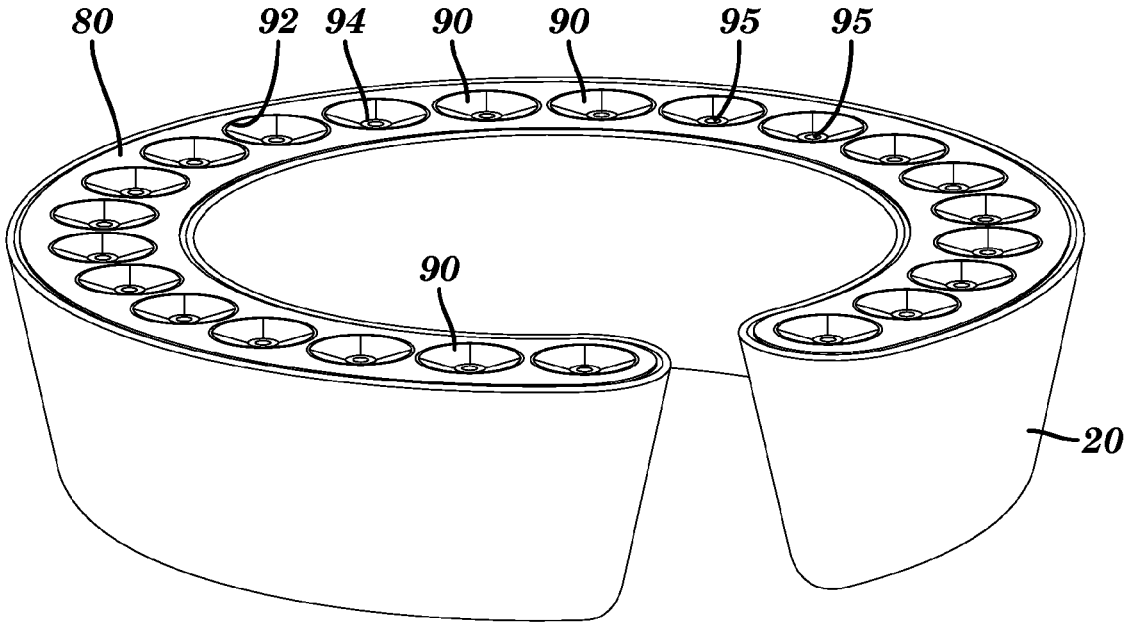
FIG. 9 is a bottom perspective view of the lighting fixture of FIG. 2 illustrating the support and a plurality of reflectors.

With reference to FIG. 9, housing 20 (FIG. 1) may include a support assembly 80 mounted in housing 20 and having a plurality of openings 84 (FIG. 10) therein, and in which are received conical reflectors 90 having a relatively large upper opening 92, and a relatively small lower opening 94. A light source 95 may be disposed in the lower opening of the conical reflector 90. The light source may be light emitting diodes. It will be appreciated that other shaped reflectors, and light sources may be suitably employed.

Figure 10:
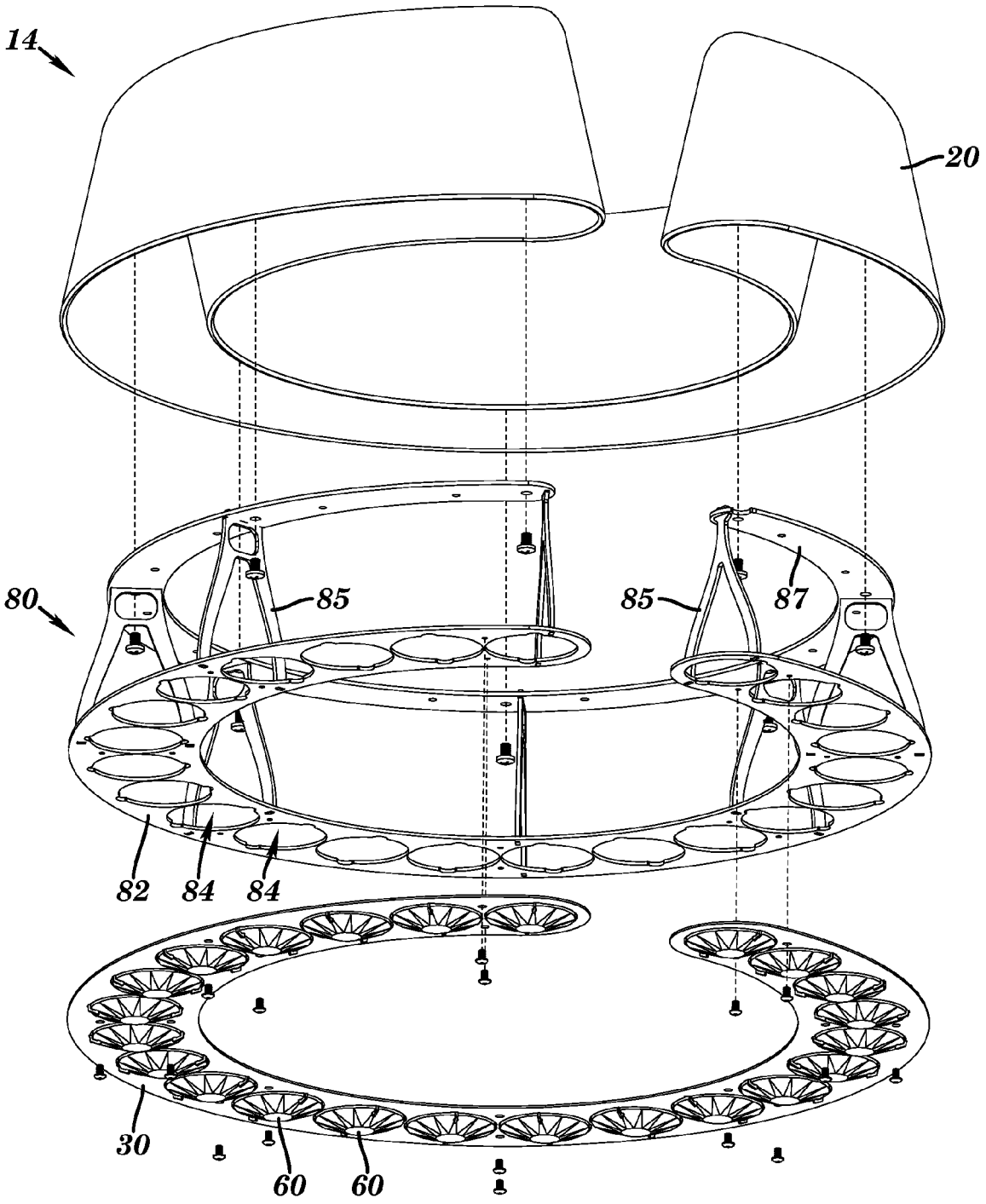
FIG. 10 is an exploded view of the lighting fixture of FIG. 1.

As best shown in FIG. 10, support 80 may be include a first ring 82 having openings 84 therein, a plurality of spacer members 85, and a second ring 87. Second ring 87 operably attaches, e.g., with screws, to housing 20. Spacer members 85 operably connect to and attach the first ring to the second ring. A plurality of screws may be used to attach the frame and ornament assembly, as described above, to the second ring. Other suitable means may be employed for attaching an assembled frame and ornaments, as described above, to the support assembly 80 and/or housing 20.

Figure 11:
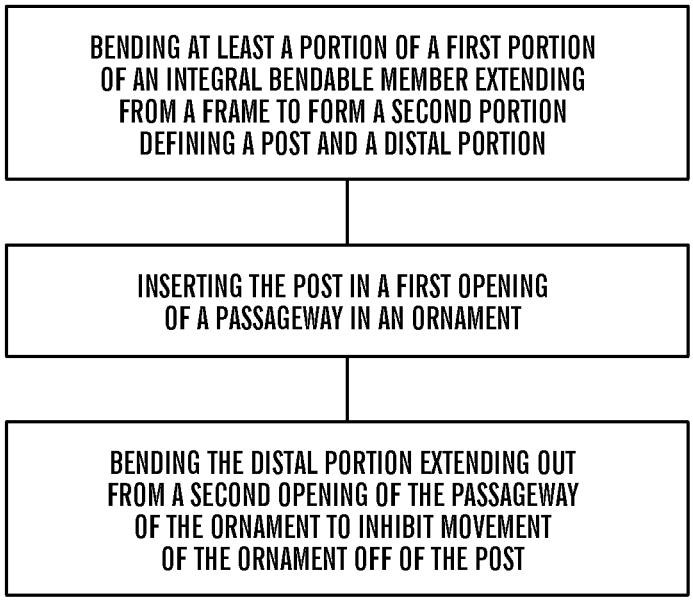
FIG. 11 is a flowchart illustrating a method for attaching a plurality of ornaments to a monolithic frame member having a plurality of integral bendable members.

FIG. 11 is a flowchart illustrating a method for attaching a plurality of ornaments to a monolithic frame member having a plurality of integral bendable members.

It will be appreciated that the frame member need not be disposed in a single plane by may be disposed in more than one plane, or may be curved. The bendable member may take other forms such as an elongated configuration which includes bending the elongated member more than the number of time described above.

Thus, while various embodiments of the present invention have been illustrated and described, it will be appreciated to those skilled in the art that many changes and modifications may be made thereunto without departing from the spirit and scope of the invention.

The invention claimed is:

1. An ornamental fixture comprising:

a monolithic frame member having at least one main surface and a plurality of integral generally U-shaped members;

a plurality of ornaments supported on said integral U-shaped members; and said plurality of integral U-shaped members having a first portion and a second portion, said first portion and said second portion defining a first leg, a second leg, and a third leg, at least a portion of said first portion being bent out of the plane of said at least one main surface of said frame member so that said third leg of said second portion forms a post out of the plane of said at least one main surface of said frame member receivable in a first opening of a passageway within an ornament, and forms a distal portion extending from a second opening out of the passageway of the ornament and said distal portion being bent to inhibit movement of the ornament off of said post.

2. The ornamental fixture of claim 1 wherein said at least said portion of said first portion being bent comprises said at least said portion of said first portion being twisted to rotate said U-shaped member.

3. The ornamental fixture of claim 1 wherein said at least said portion of said first portion being bent in a first direction, and said distal portion being bent in a second direction different from said first direction.

4. The ornamental fixture of claim 1 wherein said frame comprises a generally planar configuration, and said first portion being bent in the first direction so that said posts are disposed generally normal to the generally planar frame.

5. The ornamental fixture of claim 1 wherein said frame comprises a generally planar configuration, and said plurality of ornaments being generally aligned with the plane of said frame.

6. The ornamental fixture of claim 1 wherein said frame comprises a generally planar configuration having a plurality of cutouts for receiving the ornaments therein.

7. The ornamental fixture of claim 6 wherein said U-shaped members generally extend inwardly into said cutouts of said frame.

8. The ornamental fixture of claim 7 wherein said cutouts are round.

9. The ornamental fixture of claim 1 wherein at least some of said ornaments are supported on two U-shaped members.

10. The ornamental fixture of claim 1 wherein said frame member comprises a ring configuration having a plurality of cutouts in which said plurality of ornaments are receivable therein and supportable on said plurality of U-shaped members.

11. The ornamental fixture of claim 1 wherein said frame member comprises a ring configuration having a plurality of circular cutouts in which said plurality of ornaments are receivable therein, and some of said ornaments being supportable on two of said plurality of U-shaped members.

12. The ornamental fixture of claim 1 wherein at least a portion of said U-shaped member is disposed in a recess in said frame.

13. The ornamental fixture of claim 1 wherein said plurality of ornaments comprises a plurality of glass ornaments.

14. The ornamental fixture of claim 1 wherein said at least one main surface defines a single planar surface, more than one planar surface, or a curved surface.

15. A lighting fixture comprising:

an ornamental fixture comprising:

a monolithic frame member having at least one main surface and a plurality of integral U-shaped members;

a plurality of ornaments supported on said integral U-shaped members;

said plurality of integral U-shaped members having a first portion and a second portion, said first portion and said second portion defining a first leg, a second leg, and a third leg, at least a portion of said first portion being bent out of the plane of said at least one main surface of said frame member so that said third leg of said second portion forms a post out of the plane of said at least one main surface of said frame member receivable in a first opening of a passageway within an ornament, and forms a distal portion extending from a second opening out of the passageway of the ornament and said distal portion being bent to inhibit movement of the ornament off of said post; and at least one light source for directing light onto at least some of said ornaments.

16. The lighting fixture of claim 15 wherein said at least said portion of said first portion being bent comprises said at least said portion of said first portion being twisted to rotate said U-shaped member.

17. The lighting fixture of claim 15 wherein said at least said portion of said first portion being bent in a first direction, and said distal portion being bent in a second direction different from said first direction.

18. The lighting fixture of claim 15 wherein said frame comprises a generally planar configuration, and said first portion being bent in the first direction so that said posts are disposed generally normal to the generally planar frame.

19. The lighting fixture of claim 15 wherein said frame comprises a generally planar configuration, and said plurality of ornaments being generally aligned with the plane of said frame.

20. The lighting fixture of claim 15 wherein said frame comprises a generally planar configuration having a plurality of cutouts for receiving the ornaments therein.

21. The lighting fixture of claim 20 wherein said U-shaped members generally extend inwardly into said cutouts of said frame.

22. The lighting fixture of claim 21 wherein said cutouts are round.

23. The lighting fixture of claim 15 wherein at least some of said ornaments are supported on two U-shaped members.

24. The lighting fixture of claim 15 wherein said frame member comprises a ring configuration having a plurality of cutouts in which said plurality of ornaments are receivable therein and supportable on said plurality of U-shaped members.

25. The lighting fixture of claim 15 wherein said frame member comprises a ring configuration having a plurality of circular cutouts in which said plurality of ornaments are receivable therein, and some of said ornaments being supportable on two of said plurality of U-shaped members.

26. The lighting fixture of claim 15 wherein at least a portion of said U-shaped member is disposed in a recess in said frame.

27. The lighting fixture of claim 15 wherein said plurality of ornaments comprises a plurality of glass ornaments.

28. The lighting fixture of claim 15 wherein said at least one main surface defines a single planar surface, more than one planar surface, or a curved surface.

29. A frame member for supporting a plurality of ornaments, said frame member comprising:

a monolithic member comprising at least one main surface and a plurality of integral U-shaped members; and said plurality of generally U-shaped members having a first portion and a second portion, said first portion and said second portion defining a first leg, a second leg, and a third leg, at least a portion of said first portion being bent out of the plane of said at least one main surface of said monolithic member so that said third leg of said second portion forms a post out of the plane of said at least one main surface of said monolithic member receivable in a first opening of a passageway within an ornament, and forms a distal portion extending from a second opening out of the passageway of the ornament and said distal portion being bent to inhibit movement of the ornament off of said post.

30. The frame member of claim 29 wherein said at least said portion of said first portion being bent comprises said at least said portion of said first portion being twisted to rotate said U-shaped member.

31. The frame member of claim 29 wherein said at least said portion of said first portion being bent in a first direction, and said distal portion being bent in a second direction different from said first direction.

32. The frame member of claim 29 wherein said frame comprises a generally planar configuration, and said first portion being bent in the first direction so that said posts are disposed generally normal to the generally planar frame.

33. The frame member of claim 29 wherein said frame comprises a generally planar configuration, and said plurality of ornaments being generally aligned with the plane of said frame.

34. The frame member of claim 29 wherein said frame comprises a generally planar configuration having a plurality of cutouts for receiving the ornaments therein.

35. The frame member of claim 34 wherein said U-shaped members generally extend inwardly into said cutouts of said frame.

36. The frame member of claim 34 wherein said cutouts are round.

37. The frame member of claim 29 wherein at least some of the ornaments are supported on two U-shaped members.

38. The frame member of claim 29 wherein said frame member comprises a ring configuration having a plurality of cutouts in which said plurality of ornaments are receivable therein and supportable on said plurality of U-shaped members.

39. The frame member of claim 29 wherein said frame member comprises a ring configuration having a plurality of circular cutouts in which said plurality of ornaments are receivable therein, and some of the ornaments being supportable on two of said plurality of U-shaped members.

40. The frame member of claim 29 wherein at least a portion of said U-shaped member is disposed in a recess in said frame.

41. The frame member of claim 29 wherein said at least one main surface defines a single planar surface, more than one planar surface, or a curved surface.

42. A method for attaching a plurality of ornaments to a monolithic frame member having at least one main surface and a plurality of integral U-shaped members having a first portion and a second portion, the first portion and the second portion defining a first leg, a second leg, and a third leg, the method comprising:

bending at least a portion of the first portion of the integral U-shaped member extending from the frame out of the plane of the at least one main surface so that the third leg of the second portion defines a post and a distal portion out of the plane of the at least one main surface of the monolithic frame member;

inserting the post in a first opening of a passageway in an ornament; and bending the distal portion extending out from a second opening of the passageway of the ornament to inhibit movement of the ornament off of the post.

43. The method of claim 42 wherein the bending the at least the portion of the first portion comprises twisting the at least the portion of the first portion to rotate the U-shaped member.

44. The method of claim 42 wherein the bending the at least the portion of the first portion comprises bending the at least the portion of the first portion in a first direction, and the bending the at least a portion of the second portion comprises bending the at least the portion of the second portion in a second direction different from the first direction.

45. The method of claim 42 wherein the frame comprises a generally planar configuration, and the bending the at least the portion of the first portion comprises bending the at the least the portion of the first portion so that the posts are disposed generally normal to the generally planar frame.

46. The method of claim 42 further comprising positioning the frame and ornament adjacent to a light source.

47. The method of claim 42 wherein the frame comprises a generally planar configuration, and the plurality of attached ornaments being generally aligned with the plane of the frame.

48. The method of claim 42 wherein the at least one main surface defines a single planar surface, more than one planar surface, or a curved surface.

49. An ornamental fixture comprising:

a monolithic frame member having a plurality of integral bendable members;

a plurality of ornaments supported on said integral bendable members;

said plurality of integral bendable members having a first portion and a second portion, at least a portion of the first portion being bent so that said second portion forms a post receivable in a first opening of a passageway within an ornament, and forms a distal portion extending from a second opening out of the passageway of the ornament and said distal portion being bent to inhibit movement of the ornament off of said post; and wherein said frame member comprises a ring configuration having a plurality of circular cutouts in which said plurality of ornaments are receivable therein and some of said ornaments supportable on two of said plurality of bendable members.

50. The ornamental fixture of claim 49 wherein said frame member comprises said ring configuration having a plurality of circular cutouts in which said plurality of ornaments are receivable therein, and some of said ornaments being supportable on two of said plurality of bendable members.

51. The ornamental fixture of claim 49 wherein said at least said portion of said first portion being bent comprises said at least said portion of said first portion being twisted.

52. The ornamental fixture of claim 51 wherein said plurality of integral bendable members comprise a plurality of generally U-shaped members.

53. A lighting fixture comprising:

the ornamental fixture of claim 49; and at least one light source for directing light onto at least some of said ornaments.

54. The lighting fixture of claim 53 wherein said at least said portion of the first portion being bent comprises said at least said portion of said first portion being twisted.

55. The lighting fixture of claim 54 wherein said plurality of integral bendable members comprise a plurality of generally U-shaped members.

56. A frame member for supporting a plurality of ornaments, said frame member comprising:

a monolithic member comprising a plurality of integral bendable members;

said plurality of generally bendable members having a first portion and a second portion, at least a portion of the first portion being bent so that said second portion forms a post receivable in a first opening of a passageway within an ornament, and forms a distal portion extending from a second opening out of the passageway of the ornament and said distal portion being bent to inhibit movement of the ornament off of said post; and wherein said frame member comprises a ring configuration having a plurality of circular cutouts in which said plurality of ornaments are receivable therein and some of said ornaments being supportable on two of said plurality of bendable members.

57. The frame of claim 56 wherein said at least said portion of the first portion being bent comprises said at least said portion of said first portion being twisted.

58. The frame of claim 57 wherein said plurality of integral bendable members comprise a plurality of generally U-shaped members.

59. A method for attaching a plurality of ornaments, the method comprising:

providing a monolithic frame member comprising a ring configuration having a plurality of cutouts and a plurality of bendable members;

bending at least a portion of a first portion of the integral bendable member extending from the frame to form a second portion defining a post and a distal portion;

inserting the post in a first opening of a passageway in an ornament received in the cutout; and bending the distal portion extending out from a second opening of the passageway of the ornament to inhibit movement of the ornament off of the post.

60. The method of claim 59 further comprising supporting some of the ornaments on two of the plurality of bendable members.

61. The method of claim 59 wherein bending the at least the portion of the first portion of the integral bendable member comprises twisting the at least the portion of the first portion of the integral bendable member.

62. The method of claim 61 wherein the plurality of integral bendable members comprise a plurality of generally U-shaped members.

63. An ornamental fixture comprising:

a monolithic frame member having a generally planar configuration, a plurality of cutouts, and a plurality of integral generally U-shaped members having spaced apart legs;

a plurality of ornaments supported on said integral U-shaped members in said cutouts; and said plurality of integral U-shaped members having a first portion defining one of said legs and a second portion defining the other of said legs, at least a portion of the first portion being bent so that said second portion forms a post receivable in a first opening of a passageway within an ornament, and forms a distal portion extending from a second opening out of the passageway of the ornament and said distal portion being bent to inhibit movement of the ornament off of said post.

64. The ornamental fixture of claim 63 wherein said planar configuration comprises at least one of a single plane, more than one plane, or a curved plane.

65. A lighting fixture comprising:

an ornamental fixture comprising:

a monolithic frame member having a generally planar configuration, a plurality of cutouts, and a plurality of integral U-shaped members having spaced apart legs;

a plurality of ornaments supported on said integral U-shaped members in said cutouts;

said plurality of integral U-shaped members having a first portion defining one of said legs and a second portion defining the other of said legs, at least a portion of the first portion being bent so that said second portion forms a post receivable in a first opening of a passageway within an ornament, and forms a distal portion extending from a second opening out of the passageway of the ornament and said distal portion being bent to inhibit movement of the ornament off of said post; and at least one light source for directing light onto at least some of said ornaments.

66. The lighting fixture of claim 65 wherein said planar configuration comprises at least one of a single plane, more than one plane, or a curved plane.

67. A frame member for supporting a plurality of ornaments, said frame member comprising:

a monolithic member comprising a generally planar configuration, a plurality of cutouts, and a plurality of integral U-shaped members having spaced apart legs for supporting the plurality of ornaments in said cutouts; and said plurality of generally U-shaped members having a first portion defining one of said legs and a second portion defining the other of said legs, at least a portion of the first portion being bent so that said second portion forms a post receivable in a first opening of a passageway within an ornament, and forms a distal portion extending from a second opening out of the passageway of the ornament and said distal portion being bent to inhibit movement of the ornament off of said post.

68. The frame member of claim 67 wherein said planar configuration comprises at least one of a single plane, more than one plane, or a curved plane.

* * * * *